US005813751A

United States Patent [19]

Shaffer

[11] Patent Number: 5,813,751

[45] Date of Patent: Sep. 29, 1998

[54] DEVICE FOR PERMANENT INSTALLATION OF CHRISTMAS LIGHTING

[76] Inventor: Robert G. Shaffer, P.O. Box 3148, Lacey, Wash. 95809-3148

[21] Appl. No.: 784,031

[22] Filed: Jan. 15, 1997

Related U.S. Application Data

[60] Provisional application No. 60/020,529 Jul. 1, 1996.

[51] Int. Cl. [6] ..... F21V 21/00; F21S 3/00

[52] U.S. Cl. ..... 362/249; 362/222; 362/224; 362/225; 362/368; 362/806; 362/376

[58] Field of Search ..... 362/145, 249, 362/376, 806, 217, 219, 147, 151, 152, 221, 222, 223, 224, 225, 368; 264/148, 151

[56] References Cited

U.S. PATENT DOCUMENTS

| | | | |
|---|---|---|---|
| 2,434,781 | 1/1948 | Kurtzon | 362/219 |
| 3,204,090 | 8/1965 | Kvarda | 362/249 |
| 3,275,818 | 9/1966 | Campbell | 362/249 |
| 3,692,993 | 9/1972 | Robinson | 362/250 |
| 4,027,151 | 5/1977 | Barthel | 362/217 |
| 4,054,793 | 10/1977 | Shemitz | 362/127 |
| 4,128,863 | 12/1978 | Premetz | 362/249 |
| 4,280,169 | 7/1981 | Allen | 362/217 |
| 4,298,916 | 11/1981 | Shemitz | 362/127 |
| 4,357,653 | 11/1982 | Kovacs | 362/388 |
| 4,600,975 | 7/1986 | Roberts | 362/147 |
| 4,748,545 | 5/1988 | Schmitt | 362/219 |
| 4,774,646 | 9/1988 | L'Heureux | 362/249 |
| 4,979,078 | 12/1990 | Amstutz et al. | 362/125 |
| 5,020,252 | 6/1991 | De Boef | 40/564 |
| 5,067,061 | 11/1991 | Prickett | 362/145 |
| 5,311,414 | 5/1994 | Branham | 362/249 |
| 5,404,279 | 4/1995 | Wood | 362/145 |
| 5,420,774 | 5/1995 | Wilson | 362/376 |
| 5,469,344 | 11/1995 | Kotsakis | 362/145 |
| 5,510,966 | 4/1996 | Konecny | 362/249 |
| 5,513,081 | 4/1996 | Byers | 362/145 |
| 5,594,628 | 1/1997 | Reuter et al. | 362/249 |
| 5,658,644 | 8/1997 | Ho et al. | 428/188 |

FOREIGN PATENT DOCUMENTS

| | | | |
|---|---|---|---|
| 1059268 | 3/1954 | France | 362/223 |
| 27 45 590 | 4/1979 | Germany | 362/147 |
| 2-210703 | 8/1990 | Japan | 362/147 |

*Primary Examiner*—Ira S. Lazarus
*Assistant Examiner*—Ljiljama V. Ciric
*Attorney, Agent, or Firm*—Brian J. Coyne

[57] ABSTRACT

A device for permanent installation of exterior Christmas lighting. The device includes an elongated channel having top and bottom walls joined by a rear wall, and a front wall that depends from the top wall, and a flexible, rectangular screen cover for insertion and retention between the front wall and the bottom wall. The device, in conjunction with one or more additional devices, can be custom fit and mounted by fasteners to a building exterior, such as along principal architectural features—e.g., attached to the eaves or outlining a pitched roof. With the cover screen removed, a string of decorative Christmas lights can be positioned within and stretched from one end of the channel to an opposite end thereof, electrically connected to similar strings within additional such devices, and connected to a source of electrical power. With the devices so mounted and cover screens in place, they visually blend in with a building exterior and are hardly noticeable until the lighting is turned on, and then the illuminated decorative Christmas lighting is easily viewable through holes in the screens.

3 Claims, 6 Drawing Sheets

DEVICE FOR PERMANENT INSTALLATION OF CHRISTMAS LIGHTING

BACKGROUND OF THE INVENTION

1. Field of the Invention

The present invention pertains generally to decorative Christmas lighting displays, and more particularly to devices for permanent installation of Christmas lighting on the exteriors of buildings and other structures.

2. Related Application

The applicant filed a provisional application for the invention on Jul. 1, 1996, application Ser. No. 60,020,529.

BACKGROUND ART

During the Christmas holiday season, many people attach exposed strings of decorative lights to the exterior surfaces of their homes and other buildings, which they take down and place in storage some time following New Year's Day. Undesirable consequences of this annual ritual include injuries due to falls from ladders, damage to the strings of decorative lights due to repeated handling, and marring of the exterior surfaces from repeated insertion and removal of fasteners. On the other hand, leaving such strings of lights on building exterior surfaces year-round is aesthetically undesirable, and the lights are subject to deterioration from exposure to the elements.

In one approach to overcoming some of these problems, Kvarda, U.S. Pat. No. 3,204,090, disclosed a channel-shaped holder mountable on a building exterior and capable of holding a string of decorative lights, wherein the wiring and sockets were retained in the channel and the lamps were exposed in a straight line exteriorly of the channel. No provision was made, however, for removing the lamps from view after the end of the Christmas holiday season short of taking down the entire holder.

A second approach to overcoming these problems has been to provide a Christmas lighting fixture unit having a housing adapted for mounting on a building, the housing having an opening in a wall on which a door is mounted for movement between open and closed positions. Electric lights were swingable between a hidden position inside the housing and an exposed position extending through the opening. See, e.g., Konecny, U.S. Pat. No. 5,510,966, and Robinson, U.S. Pat. No. 3,692,993. Similarly, Branham, U.S. Pat. No. 5,311,414, provided an elongated housing structure, the housing having a hinged cover plate movable from a position that covered the light bulbs contained within the structure to a position that exposed the bulbs to view; see also, Premetz, U.S. Pat. No. 4,128,863. Another variation on this theme was provided by Wood, U.S. Pat. No. 5,404,279, who disclosed a flip open decorative hidden light trim assembly for permanent installation along the trim line of a house. The assembly included a series of linearly interconnected trim members having a hollow body containing lights and an openable reflective cover member. These approaches to the above-outlined problems with exterior decorative Christmas lighting, however, require the manufacture of relatively complex and numerous components to achieve the desired results.

There remains, therefore, a need for a relatively simple and inexpensive device for permanent installation of decorative Christmas lighting that achieves the desired results.

SUMMARY OF THE INVENTION

According to the present invention, there is provided a device for permanent installation of a string of Christmas lights on an exterior surface of a building or structure. The device includes an elongated channel and channel recess defined by horizontal top and bottom walls joined by a vertical rear wall, and a front wall depending downwards from the top wall. The rear wall has a height greater than the height of the front wall, and the top wall has a depth greater than the depth of the bottom wall. Consequently, the channel has an elongated gap between the front and bottom walls. The device further includes a flexible, rectangular screen having a length equal to the length of the channel recess and having a width sufficient to span the gap and for the screen to be received and retained between the front and the bottom walls. In a first embodiment, with the cover screen removed, a string of Christmas lights is laid within the recess with the lamps facing toward and visible through the screen and extending from one end of the channel to an opposite end. Thereafter, the screen is flexed sufficiently to place it between the bottom and front walls, the device is attached to an exterior surface of a building and connected to electrical power. In an alternative embodiment, a plurality of horizontally spaced-apart lamp sockets, connected by electrical wiring, are attached to an inner surface of the channel and oriented so that lamps inserted into the sockets face toward the gap and are visible when lit through the cover screen.

Important objectives of the present invention include the provision of an elongate device for use in conjunction with additional such devices for permanently installing Christmas lighting on an exterior surface of a building; the minimal marring of said exterior surface due to the installation; the provision of a flexible, easily removed cover screen for the device to facilitate replacing burned out Christmas light bulbs; the provision of such an elongate device that is easily cut or mitered for custom fit to a building exterior, having few parts, simple in design, durable against the elements, and inexpensive to manufacture.

Figure 2:
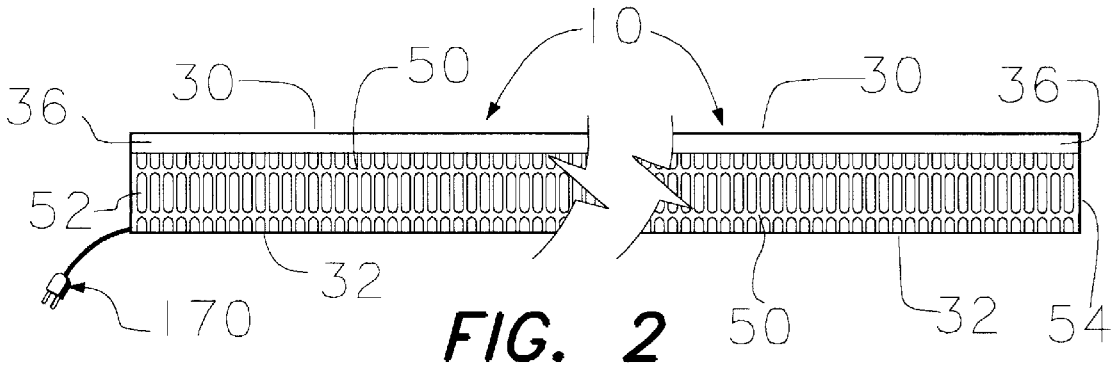
FIG. 2 is a front elevational view of the device showing the removable cover screen placed between the front wall and the bottom wall of the device.

The terms "left," "right," "front," "rear," "top," bottom," "horizontal" and "vertical" shall be understood as referring to the device 10 as oriented and depicted in FIG. 2.

DETAILED DESCRIPTION OF THE PREFERRED EMBODIMENT

Figure 1:
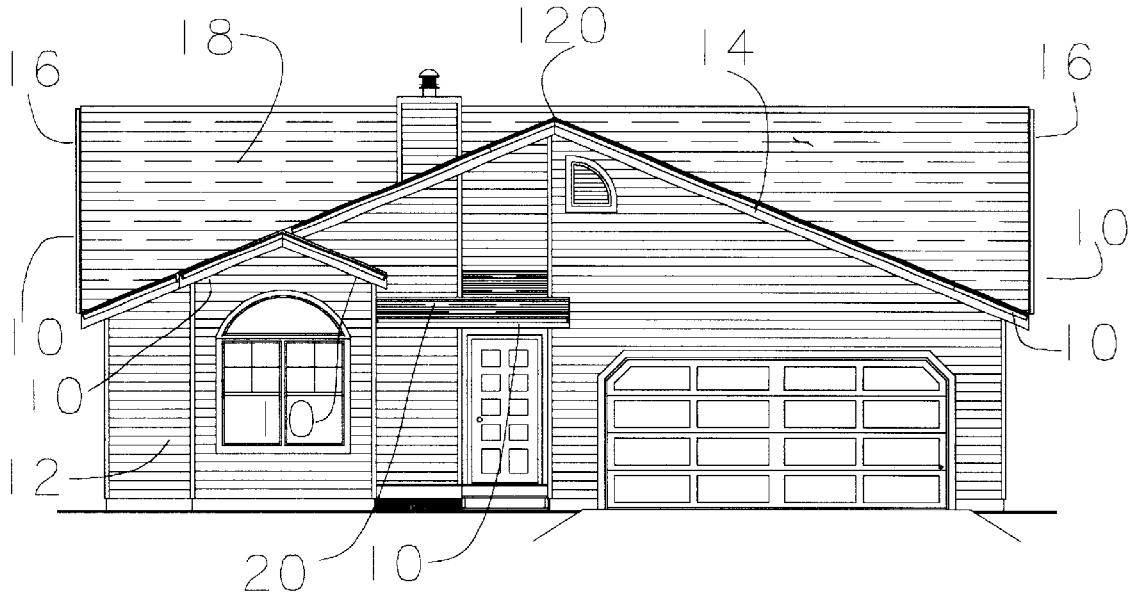
FIG. 1 is a front elevational view of a house with the device permanently installed along principal architectural features thereof.
Figure 5:
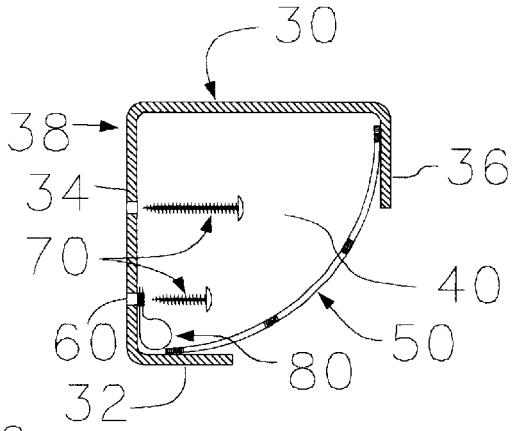
FIG. 5 is an enlarged, side elevational view of a left end of the device.
Figure 6A:
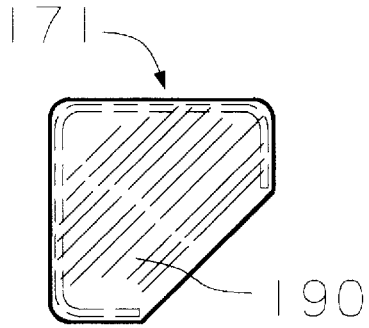
FIG. 6A is an elevational view of a left end cap of the device.
Figure 6B:
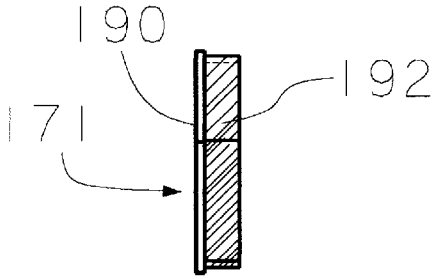
FIG. 6B is a rear elevational view of a left end cap.
Figure 7A:
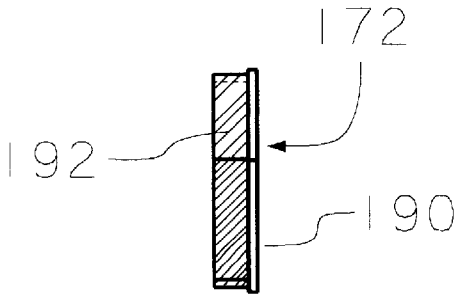
FIG. 7A is an elevational view of a right end cap of the device.
Figure 7B:
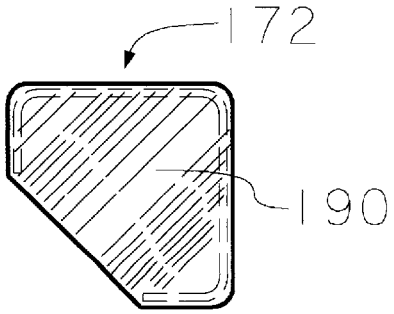
FIG. 7B is a rear elevational view of a right end cap.

Referring now to FIG. 1, a preferred embodiment of the device, denoted generally by the numeral 10, is shown permanently installed on the exterior of a house 12. The device 10 is depicted attached to principal architectural features of the house exterior 12, including the eaves 14, the edges 16 of the pitched roof 18, and the entry way roof 20, and is designed to visually blend in with the appearance of the house exterior 12. Referring now to FIGS. 2 and 5, it may be seen that the device 10 comprises a horizontal top wall 30 and a horizontal bottom wall 32 joined by a vertical rear wall 34, and a front wall 36 that depends from the top wall 30. The top wall 30 has a depth greater than the depth of the bottom wall 32, preferably by a factor of two or more. The rear wall 34 has a height greater than the height of the front wall 36, preferably by a factor of two or more. For Christmas light strings of size C-7, preferably the rear wall 34 has height 2.5 inches, the top wall 30 has depth 2.5 inches, the bottom wall 32 has depth 1.0 inch and the front wall 36 has height 1.0 inch. Each of the walls 30, 32, 34, 36 is horizontally and equally elongated, thereby defining an elongated channel, denoted generally by the numeral 38, and a channel recess 40, said channel recess 40 being the space partially surrounded by the channel 38. The walls 30, 32, 34, 36 of the channel 38 may be formed from any suitably rigid, durable and weather-resistant material, e.g., aluminum or galvanized steel, but polypropylene plastic such as that commonly used in rain gutters and downspouts is preferred. Plastic used for this purpose should be ultraviolet light protected, however, by methods well known to those of ordinary skill in the art, because, if it is not so protected, exposure to the sun will cause the material to become brittle.

Referring to FIGS. 2–5, and 13, the device 10 further comprises a flexible, rectangular cover screen 50 having an upper edge 51 and a lower edge 53. The cover screen 50 is preferably formed from polypropylene plastic, and has a plurality of openings 52 that permit viewing illuminated decorative light bulbs 61 within the channel recess 40 when the cover screen 50 is inserted and retained between the front wall 36 and the bottom wall 32. As may best be seen in FIG. 5, when so inserted the cover screen 50 is curvilinearly flexed and thus, with a slight bending, the cover screen 50 may be easily inserted into, and removed from, the channel 38. When the cover screen 50 is removed from the device it assumes the unflexed, rectangular appearance shown in FIG. 13. A suitable plastic screen for this purpose is screen number 9180 manufactured by Bemis Corporation of Sheboygan Falls, Wisc.

Figure 3:
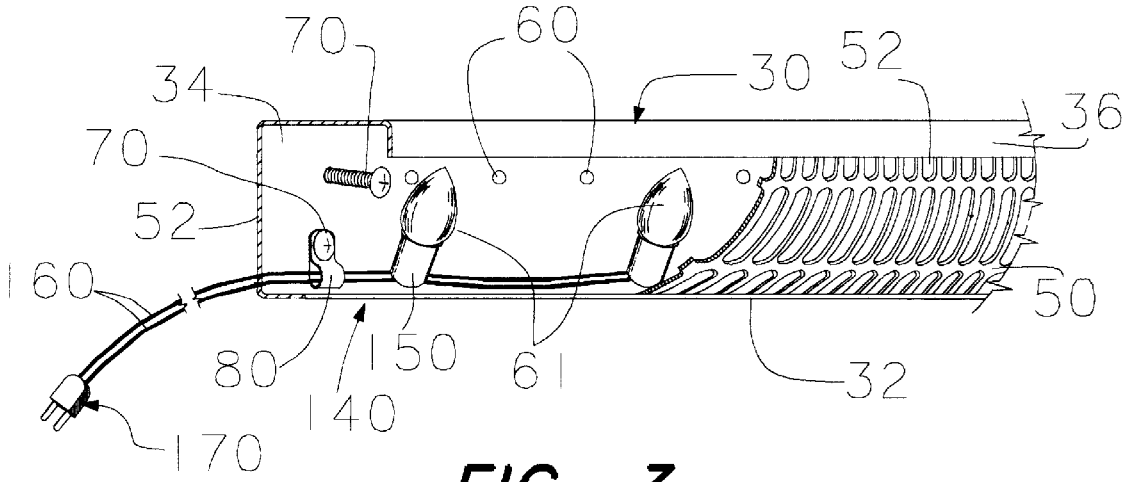
FIG. 3 shows a left end portion of the device in enlarged, frontal perspective view, with a part of the cover screen cut away.
Figure 4:
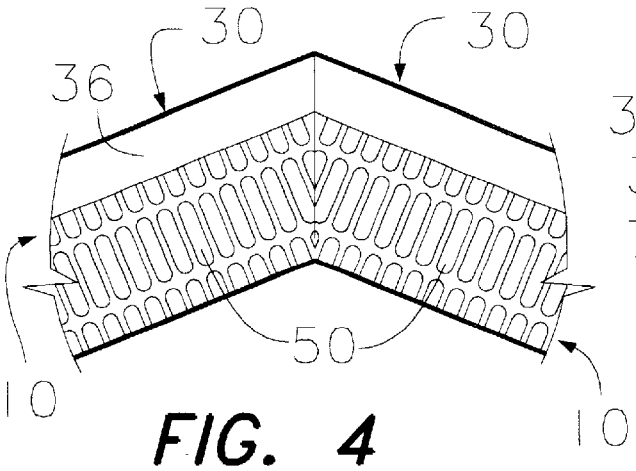
FIG. 4 is an enlarged, front elevational view of two of the devices in angled, abutting engagement as they would appear, for example, adjacent the peak of a pitched roof.
Figure 8:
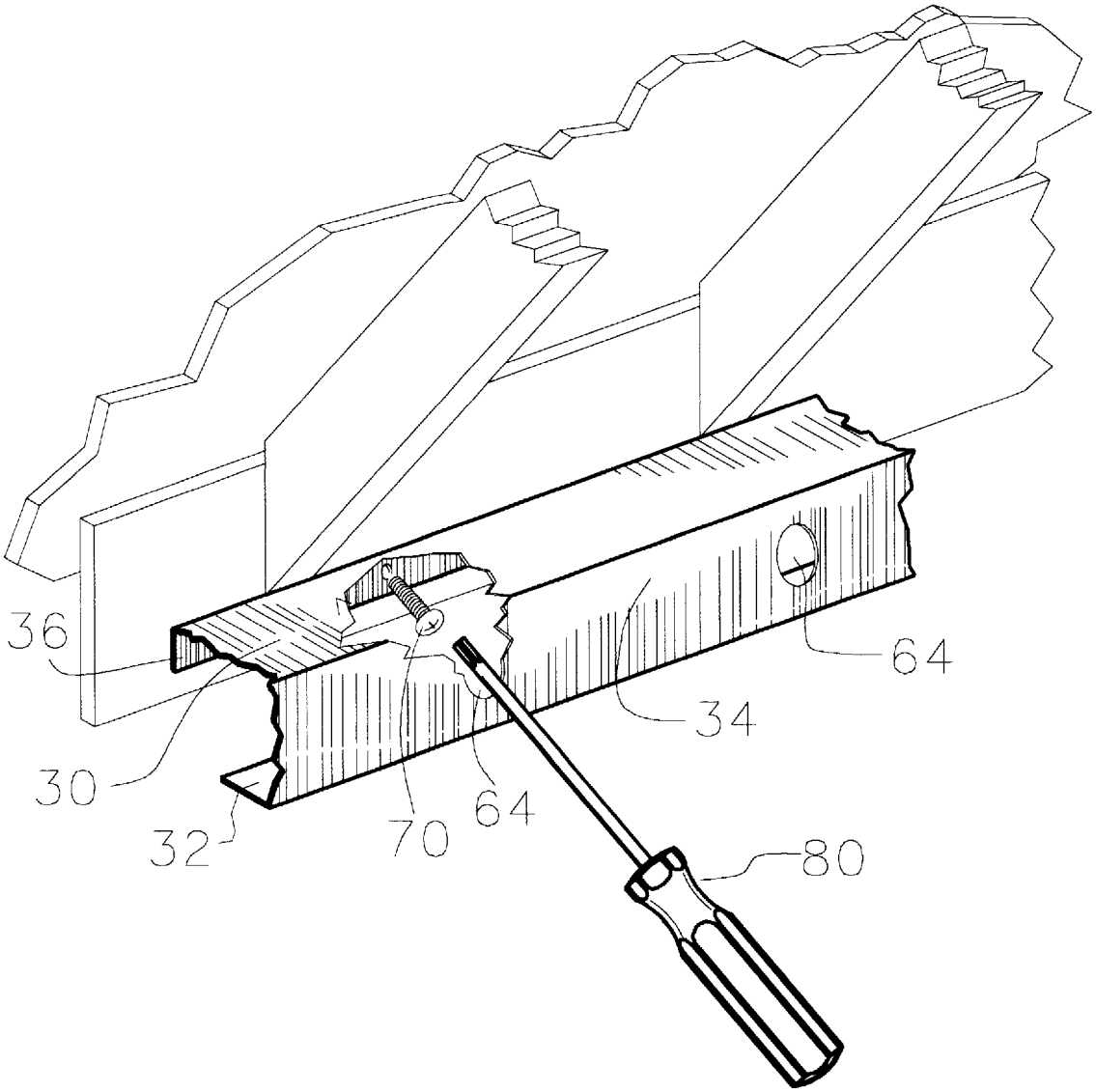
FIG. 8 is a perspective view of the device being attached to house eaves.

As shown in FIGS. 3 and 4, the rear wall 34 and front wall 36 are provided with a plurality of horizontally spaced-apart screw holes 60 for mounting the channel 38 to a surface with screws 70, for example, a vertical surface. Ample access for a screw driver 80 is available with the cover screen 50 removed for such an installation. As shown in FIG. 8, however, to attach a front wall 36 of the channel 38 to an eave, screw driver access holes 64 are provided in the rear wall 34 in register with screw holes 60 in the front wall 36.

Figure 9:
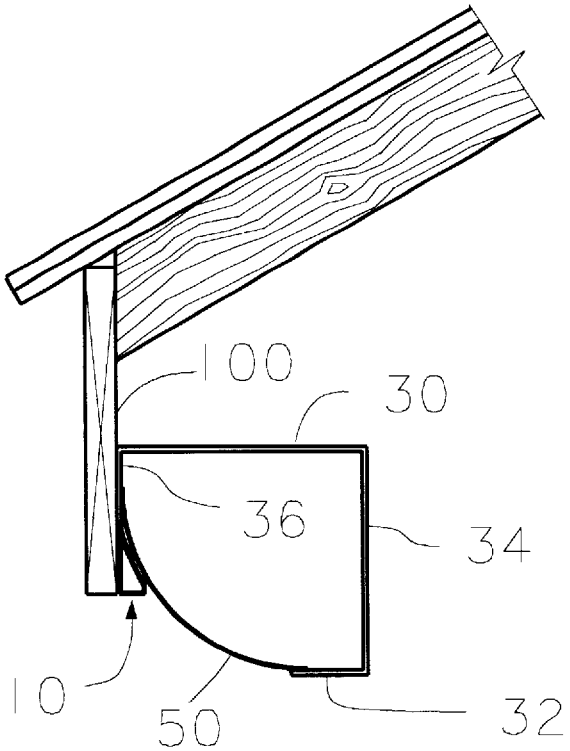
FIG. 9 is a right end view of the device attached by a J hanger to a rear surface of a vertical wall.
Figure 10:
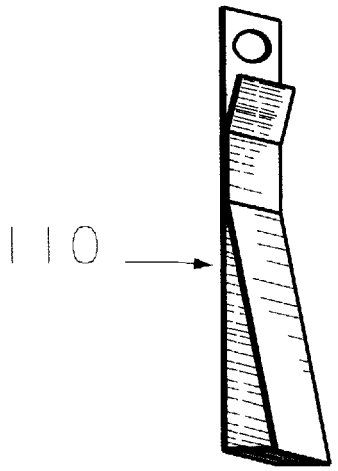
FIG. 10 is an enlarged perspective view of a J hanger.

For attachment to a rear vertical surface 100 cantilevered out from a building, as shown for example in FIG. 9, a plurality of J hangers 110 may be attached by fasteners (e.g., screws) to said surface 100, and a front wall 36 of the channel 38 may be inserted into and supported by the J hangers 110. As shown in FIG. 10, each J hanger 110 is a band of resilient metal or plastic folded back on itself and crimped.

Adjacent the peak 120 of a pitched roof, the abutting ends of two of the devices 10 may be mitered for a custom fit as shown in FIG. 4.

Figure 11:
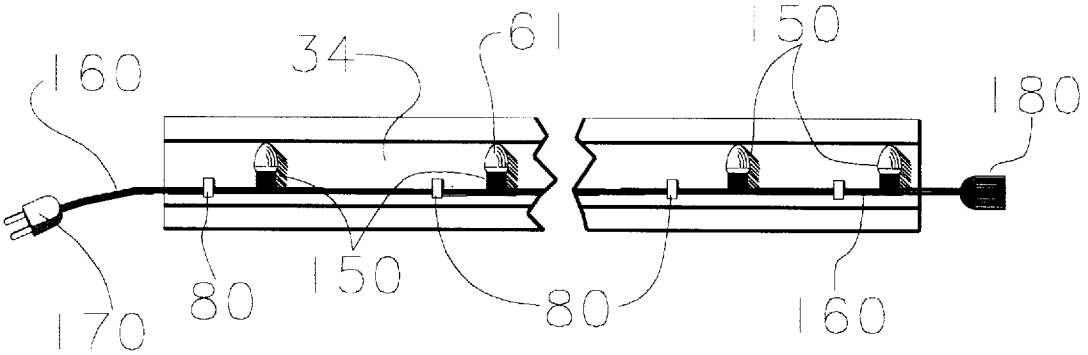
FIG. 11 is a front plan view with the cover screen removed showing a string of Christmas lights installed in the device.

Referring to FIGS. 3 and 11, with the cover screen 50 removed, a string of decorative lights, denoted generally by the numeral 140, comprising a linear series of decorative light bulb sockets 150 and light bulbs 61 connected by electrical wiring 160, a male plug 170 at one end, and a female plug 180 at an opposite end, is placed within the channel recess 40, stretching from a left end 52 to a right end 54 thereof. A cord clamp 80 is provided for securing the electrical wiring 160 to the rear wall 34. The dimensions of the channel 38 should be suitably adjusted in this embodiment to provide adequate clearance and heat dissipation for the bulb sockets and bulbs.

Except where a right end 54 of a device 10 abuts against a left end 52 of another device 10, adjacent the peak of a pitched roof for instance, a left end cap 171 and a right end cap 172 are placed over the left and right ends of a device 10, respectively. As shown in FIGS. 6A, 6B and 7A, 7B, each end cap comprises a flat plate portion 190 and a lip 192 projecting from one side thereof shaped to conform to the channel 38 as seen in end view, as shown for example in FIG. 5.

The channel 38 may be formed by plastic injection molding or by extrusion. Alternatively, aluminum or polypropylene tubing of square cross section such as those commonly used for rain downspouts can be cut longitudinally to eliminate one corner and part of the sides thereof adjacent to the corner to achieve the desired channel cross-section illustrated in FIG. 5.

Figure 12:
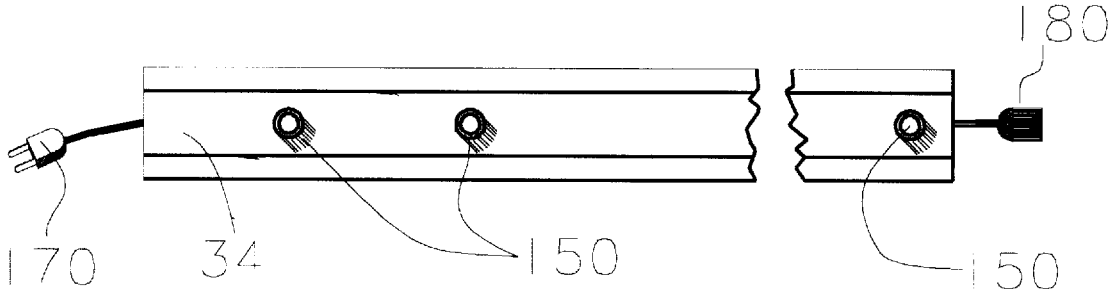
FIG. 12 is a front plan view of an alternate embodiment of the device with the cover screen removed and showing bulb sockets incorporated into a rear wall of the device.
Figure 13:
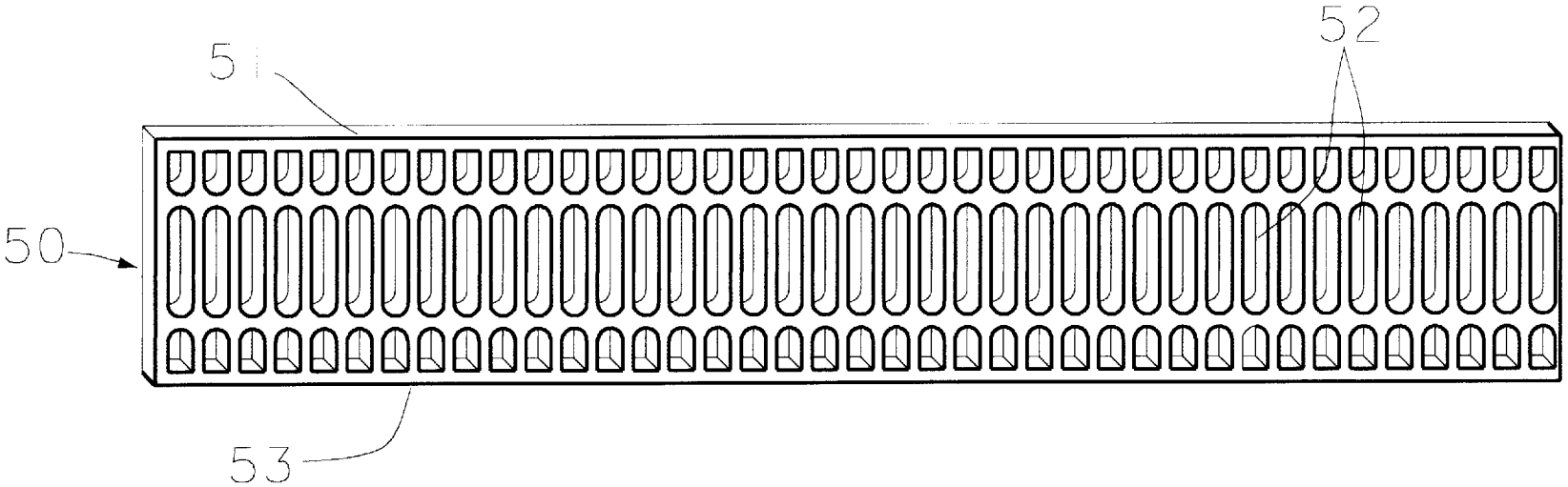
FIG. 13 is a frontal perspective view of the cover screen removed from the device.

In an alternative embodiment, a plurality of horizontally spaced-apart decorative light bulb sockets 150 are affixed to an interior surface of the channel 38, as shown in FIG. 12, connected one to the next by electrical wiring (not shown), with a male plug 170 connected to one end and a female plug 180 connected to an opposite end. If the channel 38 is a molded plastic, the sockets 150 may be an integral, molded part of the channel 38; alternatively, the sockets 150 may be affixed to the channel 38 by fasteners or adhesive.

It will be appreciated that various modifications can be made to the exact form of the present invention without departing from the scope thereof. It is accordingly intended that the disclosure be taken as illustrative only and not limiting in scope, and that the scope of the invention be defined by the following claims.

I claim:

1. A device for permanent installation of Christmas lighting on an exterior surface of a building or structure, comprising:

a horizontal top and bottom wall joined by a vertical rear wall, and a front wall depending from the top wall, the top wall having a depth larger than the depth of the bottom wall, the rear wall having a height greater than the height of the front wall, and the top, bottom, rear and front walls being horizontally elongated, thereby defining a channel and a channel recess for receiving and housing said Christmas lighting;

a removable, flexible, rectangular screen covering the channel recess and having a length equal to the length of the recess and having top and bottom edges, which screen, by deformation from a planar configuration, is insertable into the channel recess such that the upper edge engages an inside surface of the front wall and the lower edge engages an inside surface of the bottom wall; and a plurality of fasteners attached to at least one wall of the device for attaching the device to an exterior surface of a building or structure; wherein a wall of the device which is opposite said at least one wall is provided with a plurality of access holes in register with said plurality of fasteners.

2. A device for permanent installation of Christmas lighting on an exterior surface of a building or structure, comprising:

a horizontal top and bottom wall joined by a vertical rear wall, and a front wall depending from the top wall, the top wall having a depth larger than the depth of the bottom wall, the rear wall having a height greater than the height of the front wall, and the top, bottom, rear and front walls being horizontally elongated, thereby defining a channel and a channel recess;

a removable, flexible, rectangular screen covering the channel recess and having a length equal to the length of the recess and having top and bottom edges, which screen, by deformation from a planar conformation to a curvilinear conformation as seen in transverse cross section, is insertable into the channel recess such that the upper edge engages an inside surface of the front wall and the lower edge engages an inside surface of the bottom wall;

fastening means attached to at least one wall of the device for attaching the device to an exterior surface of a building or structure;

a plurality of horizontally spaced-apart Christmas light bulb sockets mounted to an interior surface of the channel;

a Christmas light bulb attached to each socket;

electrical power cords connecting the sockets; and an electrical power plug receptacle mounted to an interior surface of the channel and connected to said electric power cords.

3. The device of claim 2, wherein the fastening means includes a plurality of screws, the front wall is provided with a plurality of spaced-apart screw access holes, and the rear wall is provided with a plurality of screwdriver access holes in register with the screw access holes.

* * * * *